US008388426B2

(12) United States Patent
Tackett

(10) Patent No.: US 8,388,426 B2
(45) Date of Patent: Mar. 5, 2013

(54) METHOD AND SOFTWARE FOR MAKING NUMBER PLACE PUZZLES

(75) Inventor: Keith Martin Tackett, Houston, TX (US)

(73) Assignee: Keith M. Tackett, Houston, TX (US)

( * ) Notice: Subject to any disclaimer, the term of this patent is extended or adjusted under 35 U.S.C. 154(b) by 372 days.

(21) Appl. No.: 12/615,199

(22) Filed: Nov. 9, 2009

(65) Prior Publication Data

US 2011/0111816 A1 May 12, 2011

(51) Int. Cl.
*A63F 13/00* (2006.01)

(52) U.S. Cl. ..... 463/9

(58) Field of Classification Search ..... 463/1–6, 463/9–11

See application file for complete search history.

(56) References Cited

U.S. PATENT DOCUMENTS

| | | | | |
|---|---|---|---|---|
| 2007/0129127 | A1* | 6/2007 | Huang et al. | 463/9 |
| 2007/0173306 | A1 | 7/2007 | Chen et al. | |
| 2008/0161106 | A1* | 7/2008 | Morris | 463/31 |
| 2010/0259001 | A1* | 10/2010 | Muller et al. | 273/153 S |

FOREIGN PATENT DOCUMENTS

WO WO 2009043126 A1 * 4/2009

OTHER PUBLICATIONS

Falanagan et al. "The Ruby Programming Language", O'Reilly Media, Inc., Jan. 25, 2008.*

Grayer, Marlene, "Sudoku" (2009). MAT Exam Expository Papers. Paper 16. http://digitalcommons.unl.edu/mathmidexppap/16. published Jul. 1, 2009.*

NebraskaMATH Oct. 2009 Newsletter http://digitalcommons.unl.edu/cgi/viewcontent.cgi?article=1007&context=nebmath.*

Moon, T.K.; Gunther, J.H.; Kupin, J.J.; , "Sinkhorn Solves Sudoku," Information Theory, IEEE Transactions on , vol. 55, No. 4, pp. 1741-1746, Apr. 2009 doi: 10.1109/TIT.2009.2013004 URL: http://ieeexplore.ieee.org/stamp/stamp.jsp?tp=&arnumber=4804943&isnumber=4802290.*

* cited by examiner

*Primary Examiner* — David L Lewis
*Assistant Examiner* — Ross A Williams
(74) *Attorney, Agent, or Firm* — Patterson & Sheridan, LLP

(57) ABSTRACT

A method and computer software are provided for making number place puzzles. Numbers and unknown are represented by variables that are assigned values such as in a plurality of nested loops. Instructions within each loop limit access to embedded loops until all assigned values form a valid solution. When some of the variables are pre-assigned values to create a number place puzzle, the output will be all valid solutions, if any. Multiple solutions provide information that assists in modifying the pre-assigned values to obtain a single solution.

2 Claims, 6 Drawing Sheets

| | 1 | 2 | 3 | 4 | 5 | 6 | 7 | 8 | 9 |
|---|---|---|---|---|---|---|---|---|---|
| A | 1 | N1 | | 8 | N2 | | | N3 | 4 |
| B | | 2 | | | 1 | | | 5 | |
| C | | | 3 | | | | 6 | | |
| D | | N4 | 1 | | N5 | 4 | | N6 | 7 |
| E | | 4 | | | | | | 6 | |
| F | 8 | | | 7 | | | 1 | | |
| G | | N7 | 6 | | N8 | | 3 | N9 | |
| H | | 5 | | | 3 | | | 2 | |
| I | 4 | | | | | 7 | | | 1 |

Fig. 1

```
....
P11=1 :P12=0 :P13=0 :P14=8 :P15=0 :P16=0 :P17=0 :P18=0 :P19=4
P21=0 :P22=2 :P23=0 :P24=0 :P25=1 :P26=0 :P27=0 :P28=5 :P29=0
P31=0 :P32=0 :P33=3 :P34=0 :P35=0 :P36=0 :P37=6 :P38=0 :P39=0

P41=0 :P42=0 :P43=1 :P44=0 :P45=0 :P46=4 :P47=0 :P48=0 :P49=7
P51=0 :P52=4 :P53=0 :P54=0 :P55=0 :P56=0 :P57=0 :P58=6 :P59=0
P61=8 :P62=0 :P63=0 :P64=7 :P65=0 :P66=0 :P67=1 :P68=0 :P69=0

P71=0 :P72=0 :P73=6 :P74=0 :P75=0 :P76=0 :P77=3 :P78=0 :P79=0
P81=0 :P82=5 :P83=0 :P84=0 :P85=3 :P86=0 :P87=0 :P88=2 :P89=0
P91=4 :P92=0 :P93=0 :P94=0 :P95=0 :P96=7 :P97=0 :P98=0 :P99=1

IF P11>0 THEN P11A=P11 ELSE P11A=1
IF P11>0 THEN P11B=P11 ELSE P11B=9
....
IF P99>0 THEN P99A=P99 ELSE P99A=1
IF P99>0 THEN P99B=P99 ELSE P99B=9
FOR A1=P11A TO P11B
IF .... THEN [NEXTA1]
....
FOR F6=P66A TO P66B
IF .... THEN [NEXTF6]
PRINT "  Solution ";N
N=N+1
IF P11>0 THEN PRINT "  *";P11; ELSE PRINT "  ";A1;
....
IF P99>0 THEN PRINT "  *";P99 ELSE PRINT "  ";I9

[NEXTF6]
Next F6
[NEXTA1]
Next A1
IF N>NPMAX THEN PRINT "  QUIT AT ";NPMAX ELSE PRINT "  End"
END
```

32 31 33 34 35 36 37

Fig. 3

```
....
FOR A1=P11A TO P11B
IF N>NPMAX THEN EXIT FOR
IF (A1=P12) OR (A1=P13) OR (A1=P14) OR (A1=P15) OR (A1=P16) OR
   (A1=P17) OR (A1=P18) OR (A1=P19) THEN [NEXTA1]                  } 41
IF (A1=P21) OR (A1=P31) OR (A1=P41) OR (A1=P51) OR (A1=P61) OR
   (A1=P71) OR (A1=P81) OR (A1=P91) THEN [NEXTA1]                  } 42
IF (A1=P22) OR (A1=P23) OR (A1=P32) OR (A1=P33) OR (A1=10)
   THEN [NEXTA1]                                                   } 43
....
FOR C3=P33A TO P33B
IF N>NPMAX THEN EXIT FOR
IF (C3=C1) OR (C3=C2) OR (C3=P34) OR (C3=P35) OR (C3=P36) OR
   (C3=P37) OR (C3=P38) OR (C3=P39) THEN [NEXTC3]
IF (C3=A3) OR (C3=B3) OR (C3=P43) OR (C3=P53) OR (C3=P63) OR
   (C3=P73) OR (C3=P83) OR (C3=P93) THEN [NEXTC3]                  } 44
IF (C3=A1) OR (C3=A2) OR (C3=B1) OR (C3=B2) OR (C3=10)
   THEN [NEXTC3]
....
FOR D4=P44A TO P44B
IF N>NPMAX THEN EXIT FOR
IF (D4=D1) OR (D4=D2) OR (D4=D3) OR (D4=P45) OR (D4=P46) OR
   (D4=D7) OR (D4=D8) OR (D4=D9) THEN [NEXTD4]
IF (D4=A4) OR (D4=B4) OR (D4=C4) OR (D4=P54) OR (D4=P64) OR
   (D4=G4) OR (D4=H4) OR (D4=I4) THEN [NEXTD4]                     } 45
IF (D4=P55) OR (D4=P56) OR (D4=P65) OR (D4=P66) OR (D4=10)
   THEN [NEXTD4]
....
FOR F6=P66A TO P66B
IF N>NPMAX THEN EXIT FOR
IF (F6=F1) OR (F6=F2) OR (F6=F3) OR (F6=F4) OR (F6=F5) OR
   (F6=F7) OR (F6=F8) OR (F6=F9) THEN [NEXTF6]
IF (F6=A6) OR (F6=B6) OR (F6=C6) OR (F6=D6) OR (F6=E6) OR
   (F6=G6) OR (F6=H6) OR (F6=I6) THEN [NEXTF6]                     } 46
IF (F6=D4) OR (F6=D5) OR (F6=E4) OR (F6=E5) OR (F6=10)
   THEN [NEXTF6]
....
```

Fig. 4

Solution 1

51

| | | | | | | | | |
|---|---|---|---|---|---|---|---|---|
| *1 | 7 | 5 | *8 | 6 | 2 | 9 | 3 | *4 |
| 6 | *2 | 4 | 9 | *1 | 3 | 7 | *5 | 8 |
| 9 | 8 | *3 | 4 | 7 | 5 | *6 | 1 | 2 |
| 5 | 6 | *1 | 3 | 8 | *4 | 2 | 9 | *7 |
| 3 | *4 | 7 | 2 | 9 | 1 | 8 | *6 | 5 |
| *8 | 9 | 2 | *7 | 5 | 6 | *1 | 4 | 3 |
| 2 | 1 | *6 | 5 | 4 | 8 | *3 | 7 | 9 |
| 7 | *5 | 8 | 1 | *3 | 9 | 4 | *2 | 6 |
| *4 | 3 | 9 | 6 | 2 | *7 | 5 | 8 | *1 |

52 55

Solution 2

| | | | | | | | | |
|---|---|---|---|---|---|---|---|---|
| *1 | 7 | 9 | *8 | 6 | 5 | 2 | 3 | *4 |
| 6 | *2 | 4 | 9 | *1 | 3 | 7 | *5 | 8 |
| 5 | 8 | *3 | 4 | 7 | 2 | *6 | 1 | 9 |
| 2 | 6 | *1 | 3 | 9 | *4 | 5 | 8 | *7 |
| 3 | *4 | 7 | 5 | 8 | 1 | 9 | *6 | 2 |
| *8 | 9 | 5 | *7 | 2 | 6 | *1 | 4 | 3 |
| 9 | 1 | *6 | 2 | 4 | 8 | *3 | 7 | 5 |
| 7 | *5 | 8 | 1 | *3 | 9 | 4 | *2 | 6 |
| *4 | 3 | 2 | 6 | 5 | *7 | 8 | 9 | *1 |

Solution 3

53

| | | | | | | | | |
|---|---|---|---|---|---|---|---|---|
| *1 | 7 | 9 | *8 | 5 | 6 | 2 | 3 | *4 |
| 6 | *2 | 4 | 3 | *1 | 9 | 7 | *5 | 8 |
| 5 | 8 | *3 | 4 | 7 | 2 | *6 | 1 | 9 |
| 3 | 9 | *1 | 6 | 2 | *4 | 5 | 8 | *7 |
| 2 | *4 | 7 | 1 | 8 | 5 | 9 | *6 | 3 |
| *8 | 6 | 5 | *7 | 9 | 3 | *1 | 4 | 2 |
| 9 | 1 | *6 | 2 | 4 | 8 | *3 | 7 | 5 |
| 7 | *5 | 8 | 9 | *3 | 1 | 4 | *2 | 6 |
| *4 | 3 | 2 | 5 | 6 | *7 | 8 | 9 | *1 |

54

Solution 4

| | | | | | | | | |
|---|---|---|---|---|---|---|---|---|
| *1 | 7 | 9 | *8 | 6 | 5 | 2 | 3 | *4 |
| 6 | *2 | 4 | 9 | *1 | 3 | 7 | *5 | 8 |
| 5 | 8 | *3 | 4 | 7 | 2 | *6 | 1 | 9 |
| 2 | 6 | *1 | 3 | 8 | *4 | 5 | 9 | *7 |
| 3 | *4 | 7 | 5 | 9 | 1 | 8 | *6 | 2 |
| *8 | 9 | 5 | *7 | 2 | 6 | *1 | 4 | 3 |
| 9 | 1 | *6 | 2 | 4 | 8 | *3 | 7 | 5 |
| 7 | *5 | 8 | 1 | *3 | 9 | 4 | *2 | 6 |
| *4 | 3 | 2 | 6 | 5 | *7 | 9 | 8 | *1 |

56

End

Fig. 5

Puzzle A

61

| | | |
|---|---|---|
| *1 *2 *3 | *8 *2 *1 | *4 *5 *6 |
| *1 *4 *8 | *4 *7 | *7 *6 *1 |
| *6 *5 *4 | *3 *6 *7 | *3 *2 *1 |

Puzzle B

62

| | | |
|---|---|---|
| *1 *2 *3 | *8 *2 *1 | *4 *5 *6 |
| *1 *4 *8 | *8 | *7 *6 *1 |
| *6 *5 *4 | *3 *6 *7 | *3 *2 *1 |

Fig. 6

METHOD AND SOFTWARE FOR MAKING NUMBER PLACE PUZZLES

This application includes a computer program listing, submitted electronically as a txt file named NP.txt, incorporated by reference herein.

BACKGROUND OF THE INVENTION

1. Field of the Invention

This application relates to methods and computer software for creating games, such as creating puzzles.

2. Description of the Related Art

Number place puzzles are readily available in the market place although little or no information if available regarding how the puzzles were created. Software that assists with solving number place puzzles is also available although software that actually solves the puzzles is not widely distributed if available. Of course, software that can solve number place puzzles would be most valuable in creating number place puzzles.

The absence of software to create number place puzzles indicates a need for public disclosure of a suitable method and software for making number place puzzles to promote development of useful arts.

SUMMARY OF THE INVENTION

A method and computer software are provided for making number place puzzles. Numbers and unknowns are represented by variables that are assigned values such as by a plurality of nested loops. Instructions within each loop limit access to embedded loops until all assigned values form a valid solution. When some of the variables are pre-assigned all known values from a number place puzzle having only one solution, the output of the software would be the solution of the puzzle. However, when the variables are pre-assigned values while creating a number place puzzle, the software output will be all valid solutions, if any. Multiple solutions provide information that assists in modifying the pre-assigned values to obtain a single solution.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIG. 1 shows a sample of pre-assigned values used to illustrate the method and software of an embodiment of the present invention.

FIG. 3 shows lines of a computer program that correspond to portions of the flow diagram in FIG. 2.

FIG. 4 shows additional lines of the computer program of FIG. 3.

FIG. 5 shows the results of running the computer program of FIGS. 3. and 4.

FIG. 6 shows two separate number place puzzles created from the results shown in FIG. 5.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

Figure 2:
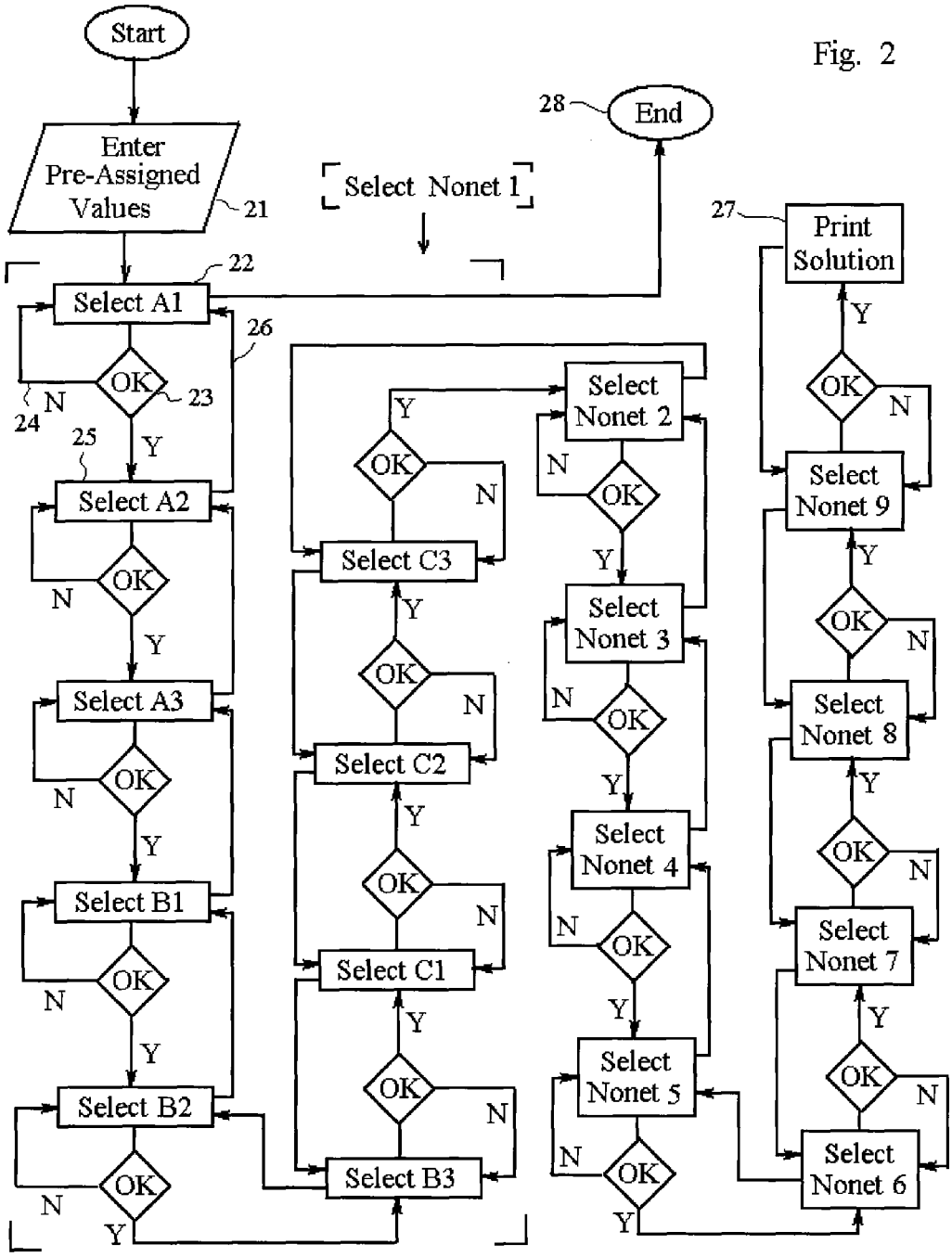
FIG. 2 shows a flow diagram of a computer program embodiment having nested loops for use in a method embodiment of the present invention.

FIG. 1 shows a number place puzzle having a 9×9 array of boxes typically used in classic Sudoku™ puzzles. The array forms 9 rows of 9 boxes labeled A through F and 9 columns of 9 boxes labeled 1 through 9. Pre-assigned values have been selected to illustrate making a number place puzzle. The values can be pre-assigned in any manner as long as the rules of the number place puzzle are obeyed, e.g. each row, column, and nonet (3×3 array) has no duplicate numbers for a classic Sudoku™ puzzle. The values can be pre-assigned before the program is executed as shown in the following Figures. Alternatively, the program can assist in selecting variables using graphics and dropdown windows.

Each box in the example puzzle of FIG. 1 is readily identified by the row and column, e.g. box A1 is preset at 1. For use in the following description, each nonet in FIG. 1 is labeled in the top center boxes N1, N2, N3, N4, N5, N6, N7, N8, and N9. The selection of pre-assigned values in FIG. 1 was assisted by the computer program listing (NP.txt) filed with this application although selection can be done manually.

FIG. 2 shows a diagram of a computer program for making number place puzzles according to an embodiment of the present invention. The source code for one such program written in BASIC is shown in the computer program listed. The BASIC program was written using JUSTBASIC 1.01 which is freeware available at www.justbasic.com. The attached BASIC program is not free for use in making number place programs if one or more claims below are granted. The computer program can be written in any program language and for any number place puzzle.

The embodiment shown in FIG. 2 uses eighty-one (81) nested loops to assign each of the eighty-one (81) variables in the 9×9 number place puzzle of FIG. 1 as described in more detail for FIG. 4. Pre-assigned values are entered 21 and are processed by limiting selection of each variable to the corresponding pre-assigned value as described in more detail for FIG. 3. After a value is selected for each variable, such as selection of a value for A1 22, the value is compared 23 to relevant pre-assigned values and relevant values previously assigned to the variables by the nested loops. The value is not compared to variables that are to be assigned in any loops that are embedded in the loop that assigned the value because the embedded variables are not yet assigned a value for comparison. However, comparison of the value to embedded variables will occur when each embedded variable is subsequently assigned a value.

When the selected value for a variable is the same as a compared value, embedded loops are bypassed 24 for selection of another value for the same variable. If the selected value if different from all compared values, the value of the next variable is selected, such as selection of A2 25. The selection of successive variables continues as long as each new value satisfies the comparisons. When no value satisfies the comparisons for a variable, processing returns to selection of the prior variable, e.g. selection of A2 exits 26 to selection of another value for A1.

When all selected variables satisfy the comparisons, the variables are printed 27. Thus, the comparison instructions within each loop limit access to successive loops that would print the variables. The computer program ends 28 after the possible combinations of the variables have been tested, such that all possible solutions are printed absent limitation on the number of printed solutions. When the computer program listing (NP.txt) is executed with JUSTBASIC 1.01, up to 50 solutions (when NPMAX=50) are printed to a window and can be saved in a file or printed.

FIG. 3 shows lines from the computer program listing which illustrate entry of pre-assigned values 31, limitation of variables from A1 to F9 to any preset value 32, and selection of variables from A1 to F6 33 using For/Next statements. In the computer program listing, selection of variables begins with N1 of FIG. 1 and progresses through N6, N8, N2, N4, N9, N3, N7, and N5. The order of the nonets for selection of values was chosen to assist in writing the program by having a sequence wherein selected values in Nonet 1 in FIG. 2 (N1) were not comparable to values in Nonet 2 (N6) or Nonet 3 (N8) and selected values in Nonet 4 (N2) were not comparable to values in Nonet 5 (N4) or Nonet 6 (N9). The same result would be achieved by similar sequences such as the reverse sequence N5, N7, N3, N9, N4, N2, N8, N6, and N1.

After successful selection of all variables without duplicates, the computer program listing prints a header 34 that keeps count of the solutions and prints all variables 35. When a variable such as A1 of F6 is a duplicate to a pre-assigned value or a previously selected value, processing jumps to a label positioned before the corresponding Next statement 36. After all combinations are processed, the final commands print "End" 37 to show that processing is completed unless the program terminated by setting NPMAX to a number less than the number of solutions.

FIG. 4 shows additional lines from the computer program listing to illustrate how comparison of variables is completed for N1 and N4 in FIG. 1. For each variable, the selected value is compared to pre-assigned values and previously selected values in the same row 41, pre-assigned values and previously selected values in the same column 42, and then pre-assigned values and previously selected values for remaining boxes in the same nonet 43. As shown in FIG. 4, subsequent comparisons 45, 45, 46 include more previously selected values and fewer pre-assigned values than the prior comparisons because the previously selected values would be identical to any pre-assigned value for the same variable.

When multiple solutions are obtained, further pre-assignment of values may be assisted by comparing the multiple solutions. For example, the pre-assigned values shown in FIG. 1 have the four solutions shown in FIG. 5 (which shows the result of executing the computer program listing NP.txt filed with this application). Comparing the solutions, only Solution 1 has a value of 2 at A6 51 and a value of 6 at I4 52, thus pre-assignment of both values would result in a single solution for the corresponding puzzle 61 shown in FIG. 6. Similarly pre-assignment of both A6 53 and I4 54 in Solution 2 would result in a single solution. Assignment of I7 in Solution 1 or assignment of I7 in Solution 4 would also result in unique solutions although less symmetrical.

Puzzles having a single solution can be modified to be more symmetrical as shown in FIG. 6. The puzzle 61 created in the description above was modified by removing the pre-assigned values for F4 and D6. Execution of the computer program listing (NP.txt) after modification resulted in 26 solutions and only the first solution resulted in the value 8 for E5. Thus, a more symmetrical puzzle 62 was obtained by pre-assigning the value 8 to E5. Whenever no solution remains, removal of one pre-assigned value can also result in a single solution or a different set of multiple solutions that can be examined for a single solution.

While the foregoing is directed to embodiments of the invention, other and further embodiments of the invention may be devised without departing from the basic scope thereof.

What is claimed is:

1. A method for making a number place puzzle, comprising:

determining multiple solutions for pre-assigned values using a computer readable medium having instructions for making a number place puzzle, the computer readable medium comprising:

a plurality of printing instructions to print all solutions to a number place puzzle having multiple solutions;

a plurality of instructions terminating printing of solutions after printing all solutions or printing a predetermined number of solutions less than all solutions; and a plurality of instructions at a plurality of locations that limit access to the printing instructions until all assigned values form a valid solution to the puzzle; and examining the multiple solutions to modify the pre-assigned values to obtain a single solution using the computer readable medium.

2. The method of claim 1, wherein the predetermined number of solutions is 50.

* * * * *